United States Patent [19]

Yagisawa

[11] Patent Number: 4,969,477

[45] Date of Patent: Nov. 13, 1990

[54] SMOKING MATERIALS

[75] Inventor: Masaru Yagisawa, Tokyo, Japan

[73] Assignee: Ikeda Bussan Kaisha, Ltd., Tokyo, Japan

[21] Appl. No.: 258,760

[22] Filed: Oct. 17, 1988

[51] Int. Cl.[5] ..... A24D 1/18; A24B 15/18

[52] U.S. Cl. ..... 131/359; 131/369

[58] Field of Search ..... 131/359, 369

[56] References Cited

U.S. PATENT DOCUMENTS 3,034,931 5/1962 Kiefer ..... 131/359

*Primary Examiner*—V. Millin

*Attorney, Agent, or Firm*—Armstrong, Nikaido, Marmelstein, Kubovcik & Murray

[57] ABSTRACT

Disclosed is a smoking material mainly composed of fruit fiber of pineapple. Lees remaining after pressing the juice from pineapple pulp is dried, rolled, cut, flavored and moistened, and then the resultant product looks like tobacco. It can be formed into nicotine-free cigarettes if no tobacco is blended. The smoking material or tobacco substitute is free of unpleasant taste and irridation, and it can be flavored to give mild taste. Also, controlled amount of tobacco leave can be blended with the tobacco substitute to produce a smoking material having a reduced nicotine content.

2 Claims, No Drawings

SMOKING MATERIALS

BACKGROUND OF THE INVENTION

1. Field of the Invention

The present invention relates to a smoking material or tobacco substitute.

2. Related Art

The harmfulness of tobacco to health has been discussed hotly. Usually the habit of smoking is difficult to be broken. Therefore, in an attempt to reduce the harmfulness of tobacco to health a variety of improved filters have been proposed. Cigarettes which are modified to draw air in and qualify the smoke, are marketed. Also, a variety of nicotine-free tobacco substituets have been proposed. These are made of tea leaves, Japan cedar leaves, pine leaves, corn silk, orange peel, Japan knotweed leaves, lettuce or partially oxidized cellulose resulting from purified pulp. These substitutes, however, are less pleasing in appearance, taste and flavor. No tobacco substitute is pleasing enough to serve in place of tabacco.

In view of this the inventor had engaged himself in finding any smoking material or nicotine-free tobacco substitute which can be prepared in the form of cigarette, and can be commercially available at a reduced cost all the time, and finally the inventor found that dried lees remaining after pressing the juice from pineapple pulp is appropriate for the purpose.

Pineapples are a tropical plant, particularly a perennial grown in the tropics, producing a single fruit for each plant. In Philippines, Taiwan and other Southeast Asian countries, Hawaii and Caribean coast, pineapples are cultivated at a large scale, and a large amount of pineapples are exported as raw fruit. Also, pineapple meat is canned and exported. Otherwise, pineapples are pressed to remove the juice, and bottled juice is exported.

A large amount of factory product is exported. Accordingly, a large amount of lees remaining after pressing the juice from pineapple pulp result. Almost all lees are thrown away, and only a minor part is used as feed.

The inventor carried out an analysis of dried pineapple lees to find that they have essential ingredients of substantially same ratios as dried tobacco except for nicotine. Also, the inventor found that a conventional method of producing cigarettes although somewhat modified, can be applied to pineapple lees. Cigarettes of pineapple lees look like tobacco cigarettes in appearance and color, and they burn like tobacco cigarettes.

SUMMARY OF THE INVENTION

One object of the present invention is to provide a smoking material or tobacco substitute which is free of nicotine, still satisfying smokers' taste compared with conventional tobacco substitutes.

Another object of the present invention is to provide a smoking material which can be blended with tobacco leaves without appreciably changing tobacco flavor, but substantially reducing the content of nicotine in cigarettes.

To attain these objects a smoking material or tobacco subsitute according to the present invention is mainly composed of fruit fiber of pineapple. Specifically, dried lees remaining after pressing the juice from pineapple pulp is used as a smoking material.

Lees remaining after pressing the juice from pineapple pulp are soaked in water twice as much as the weight of the pineapple meat to remove the fragments of meat and pieces of pineapple rind, and then lees are pressed and dried. The results of analysis of the dried lees along with those of dried tobacco leaves are shown in the following Table 1:

TABLE 1

| | Pineapple lees (% by weight) | Yellow tobacco leaves (% by weight) |
|---|---|---|
| Water content | 10.7 | 10–20 |
| Crude protein | 4.1 | 3–5 |
| Crude fat | 1.1 | 1–3 |
| Crude fiber | 16.4 | 8–10 |
| Crude ash | 3.0 | 11–14 |
| Soluble nitrogen free content | 65.7 | 50–60 |
| Soluble nitrogen content | 0.0 | 2–3 |
| Total | 100.0 | |
| (Carbohydrate | 24.0 | 20–25) |

Untreated pineapple lees has much more carbohydrate and soluble nitrogen-free content than treated or washed pineapple lees in Table 1, and such untreated lees are sticky to the touch unlike treated lees.

Lump of treated lees are mainly consisted of cellulose in the form of long fiber length and fine diameter fiber. These fibers are not strong enough to weave cloth. The fibers of pineapple leaves have been traditionally used in weaving cloth in some districts of Southeast Asia.

Dried product of treated or washed pineapple lees has water content of approximately 10%. When water is added to increase the water content high to approximately 30%, the so moistened lees can be rolled into sheet. This appears to be attributable to the fact that it has relatively long fiber length and that it contains pectin, which may act as binder. At first, treated lees are light yellow, and they become brown while being exposed to air. After being dried, rolled and cut, the lees look like pipe tobacco of high quality in appearance. Cut lees are combussible like tobacco, free from any peculiar taste and non-irritating. An alcoholic solution containing appropriate flavor and moisturizer are added by spraying to the smoking material, and the alcohol as solvent in the solution is allowed to vaporize and leave the smoking material. The final product whose water content ranges from 8 to 15%, preferably 11%, can be formed into cigarette according to the same process of forming finely cut tobacco into cigarette. The resultant tobacco substitute is free of nicotine, still assuring that a smoker may have the substantially same pleasure and taste as tobacco cigarette. The tobacco substitute can be blended homogeneously with finely cut tobacco, thereby permitting production of cigarette containing a reduced amount of nicotine.

A lot of pineapple lees are being yielded as useless product in factories where the juice is being pressed, and advantageously the material is available all the time. If pineapple lees were a seasonal product, there would be need to store the material as much as would be used up before it can be commercially available again in the next crop season. Advantageously, there is no need to store pineapple lees for the fear of seasonal shortage. The dried pineapple lees have water content of approximately 10%, and this reduced water content makes it easy to store and transport the raw material.

PREFERRED EMBODIMENTS OF THE INVENTION

Lees remaining after pressing the juice from pineapple pulp were soaked in water to remove fragments of meat and pieces of pineapple rind. Then, the wet lees were subjected to centrifugal separation to remove water. The dewatered lees were naturally dried one day long to reduce their water content to approximately 30% (if the lees were dried too much, water should be sprayed on the lees until their water content increases to 25–35%).

Then, the material was fed to opposite steel rolls to be rolled into sheet approximately 0.3 mm thick. The sheet material was finely cut about 0.3 mm wide and 5 mm long. Cigarette flavor was sprayed on the cut material. The flavoured material was naturally dried one day long. The following three different cigarettes were produced from the smoking material thus prepared:

① cigarettes as large as HI-LITE (registerd trademark of NIHON TABACCO SANGYO K.K.) which the size is 85 mm long and 8 mm diameter were made of non-flavored material;

② cigarettes as large as HI-LITE were made of flavored material; and

③ cigarettes as large as HI-LITE were made of flavored material ② (50%) and finely cut tobacco (50%), which tobacco was used.

HI-LITE cigarettes were tested for comparison. Specifically, the nicotine contents of the inhaled smokes from Hilight and these cigarettes ①, ② and ③ were determined. Also, 5 panelers smoked Hilight and these cigarettes to estimate their taste as shown in the following Table 2. A constant-flowing type smoking apparatus was used in determining their nicotine contents. Specifically, smoke was inhaled 2 seconds at every interval of 58 seconds, and the flow rate of smoke was 1.75 ml/second. The smoke was filtered by Cambridge Filter CM 113. The substance remaining in the filter was collected and subjected to steam distillation to separate nicotine. The amount of nicotine was determined in terms of absorption of 259 mili-microns ultraviolet rays. Likewise, the amount of nicotine remaining in the filter tip of each cigarette was determined. Then, the total amount of nicotine was deemed to be equal to the nicotine content of a concerned cigarette.

TABLE 2

| Smoking materials | Nicotine content (mg) Total amount | Nicotine in filter tip | Taste |
|---|---|---|---|
| ① Cut lees | 0.00 | 0.00 | Tasteless and bland |
| ② Flavored cut lees | 0.00 | 0.00 | Tasteless and no unpleasant some degree of satisfaction |
| ③ HI-LITE (50%) plus flavored cut lees (50%) | 0.74 | 0.52 | Mild satisfaction of smoking |
| Control; HI-LITE | 1.36 | 0.95 | Somewhat irritant |

As described above, lees remaining after pressing the juice from pineapple pulp is dried, rolled, cut, flavored and moistened, and then the resultant product looks like tobacco. It can be formed into nicotine-free cigarettes if no tobacco is blended. The smoking material or tobacco substitute is free of unpleasant taste and irritation, and it can be flavored to give mild taste. Also, a controlled amount of tobacco leaf can be blended with the tobacco substitute to produce a smoking material having a reduced nicotine content. In the examples given above cigarette flavors were used, and the resultant tobacco substitute was somewhat bland. The smoking taste, however, can be improved by using thick flavors.

What is claimed is:

1. A smoking material comprising dried and comminuted fruit fiber of the pineapple which has been sprayed with tobacco flavoring solution.

2. A smoking material comprising dried and comminuted fruit fiber of the pineapple and finely cut tobacco.

* * * * *